US007104633B2

(12) United States Patent
Kim et al.

(10) Patent No.: US 7,104,633 B2
(45) Date of Patent: Sep. 12, 2006

(54) MONOLITHIC INK-JET PRINTHEAD AND METHOD OF MANUFACTURING THE SAME

(75) Inventors: Il Kim, Suwon (KR); Seo-hyun Cho, Sungnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/200,325

(22) Filed: Jul. 23, 2002

(65) Prior Publication Data

US 2003/0085960 A1 May 8, 2003

(30) Foreign Application Priority Data

Nov. 2, 2001 (KR) ..... 2001-68246

(51) Int. Cl.
*B41J 2/05* (2006.01)

(52) U.S. Cl. ..... 347/65; 347/62

(58) Field of Classification Search ..... 347/20, 347/56, 61–65, 12, 67, 94, 44, 47, 57–59, 347/54

See application file for complete search history.

(56) References Cited

U.S. PATENT DOCUMENTS 4,809,428 A * 3/1989 Aden et al. ..... 29/611
4,894,664 A * 1/1990 Tsung Pan ..... 347/65
6,132,032 A * 10/2000 Bryant et al. ..... 347/59

FOREIGN PATENT DOCUMENTS

JP 09-048121 A * 2/1997
JP 9048121 * 2/1997

OTHER PUBLICATIONS

U.S. Appl. No. 10/198,173, filed Jul. 19, 2002, Il Kim et al.

* cited by examiner

*Primary Examiner*—Juanita D. Stephens
(74) *Attorney, Agent, or Firm*—Staas & Halsey LLP

(57) ABSTRACT

An ink-jet printhead includes a substrate, a doughnut-shaped heater formed on the top surface of the substrate, an ink chamber barrier disposed on the substrate to enclose the heater, an ink chamber defined by the substrate and the ink chamber barrier, and an ink passage extending through the substrate in the perpendicular direction to the surface of the heater. The ink passage includes a narrow passage and a wide passage. The narrow passage communicates with the ink chamber. The ink passage concentrically communicates with an opening formed at the center of the heater and a nozzle. An ink introducing direction for supplying the ink into the ink chamber coincides with an ink ejecting direction for ejecting the ink from the nozzle, and the ink chamber barrier is disposed between the substrate and the nozzle plate.

21 Claims, 7 Drawing Sheets

MONOLITHIC INK-JET PRINTHEAD AND METHOD OF MANUFACTURING THE SAME

CROSS-REFERENCE TO RELATED APPLICATIONS

This application claims the benefit of Korean Application No. 2001-67213 filed Oct. 30, 2001 in the Korean Patent Office, the disclosure of which is incorporated herein by reference.

BACKGROUND OF THE INVENTION

1. Field of the Invention

The present invention relates to an ink-jet printhead for use in an ink-jet printer or a facsimile, and more particularly, to a thermal ink-jet printhead.

2. Description of the Related Art

In a general thermal ink-jet printhead, ink filled in an ink chamber is rapidly heated by using a heater to generate a bubble, and a droplet of the ink is ejected onto a print medium by the expansive force of the bubble to form an image on the print medium.

Meanwhile, the thermal ink-jet printhead may be classified into an edge-shooter type ink-jet printhead, a roof-shooter type ink-jet printhead, and a back-shooter type ink-jet printhead according to an ink ejecting method.

In the edge-shooter type ink-jet printhead, as described in U.S. Pat. No. 4,490,728, to Vaught et al., issued Dec. 25, 1984, the ink is introduced into the ink chamber in an ink introducing direction parallel to a surface of the heater (i.e., the ink introducing direction for passing through a side of the ink chamber), and then ejected through a nozzle in an ink ejecting direction parallel to the surface of the heater. In the edge-shooter type ink-jet printhead, since the ink introducing direction for introducing the ink into the ink chamber coincides with the ink ejecting direction for ejecting the ink through the nozzle, there is an advantage in that the ink is introduced into the ink chamber and stably ejected through the nozzle. However, there is also a disadvantage in that productivity of the ink-jet printhead is reduced. That is, in order to fabricate the edge-shooter type ink-jet printhead, the heater is formed on a substrate, and then an attachment process is performed twice to attach an ink chamber barrier layer for forming the ink chamber on the substrate and a nozzle plate, in which the nozzle is formed, in turn.

In the roof-shooter type ink-jet printhead, as described in U.S. Pat. No. 6,060,208, to Wang, issued May 9, 2000, the ink is introduced into the ink chamber in the ink introducing direction parallel to a surface of the heater, and then, ejected through the nozzle in the ink ejecting direction vertical to the surface of the heater. In the roof-shooter type ink-jet printhead, the ink chamber is formed on the nozzle plate. Then, the substrate on which the nozzle plate and the heater are formed is attached. Therefore, since the attaching process is performed only once to fabricate the ink-jet printhead, there is an advantage that the productivity is higher than that of the edge-shooter type ink-jet printhead. However, since the ink introducing direction into the ink chamber is vertical to the ink ejecting direction through the nozzle, there is a disadvantage that the ink is unstably ejected.

Further, in the back-shooter type ink-jet printhead, as described in U.S. Pat. No. 5,760,804, to Heinzi et al., issued Jun. 2, 1998, the ink is passed through the heater in the direction vertical to the surface of the heater and then ejected. As shown in FIG. 1, the back-shooter type ink-jet printhead includes a substrate 1, a doughnut-shaped heater 2 formed on an upper surface of the substrate 1 and having an opening at a center portion thereof, and a nozzle plate 3 stacked on an upper surface of the heater 2.

The substrate 1 is provided with an ink chamber 4 formed below the heater 2 and an ink passage 5 communicating with the ink chamber 4. The nozzle plate 3 has a nozzle 3*a* communicating with the opening of the heater 2. The nozzle 3*a*, the opening of the heater 2, the ink chamber 4 and the ink passage 5 are concentrically communicating with each other. The ink is introduced through the ink passage 5 into the ink chamber 4, and then ejected through the nozzle 3*a* in the ink ejecting direction vertical to the surface of the heater 2. As described above, in the back-shooter type ink-jet printhead, the ink introducing direction coincides with the ink ejecting direction. A reference numeral 6 is a bubble generated by heating the heater 2.

Generally, the back-shooter type ink-jet printhead is fabricated without using the attaching process by a monolithic method, which is different from the edge-shooter type or roof-shooter type ink-jet printhead. First of all, the heater 2 is formed on the substrate 1. The nozzle plate 3 is stacked thereon by a chemical vapor deposition (CVD) method. Then, the nozzle 3*a* is formed in the nozzle plate 3. The heater 2 is etched through the nozzle 3*a* to form the opening at the center portion of the heater 2. The substrate 1 is etched to form the ink chamber 4 and the ink passage 5 in turn. The back-shooter type ink-jet printhead has a high productivity compared with the edge-shooter type or roof-shooter type ink-jet print head since the attaching process is not required to form the nozzle plate 3 or the ink chamber 4 in the monolithic process.

However, in the back-shooter type ink-jet printhead shown in FIG. 1, since a path along which the heat generated from the heater 2 is conducted is remarkably shorter than that in the edge-shooter type or roof-shooter type ink-jet printhead, the cooling rate of the heater 2 is low. In the ink-jet printhead, the number of ink droplets that can be ejected per hour, i.e., the ejection frequency, depends on the cooling rate of the heater 2. The low cooling rate of the heater 2 reduces the ejection frequency of the ink and results in the low print speed of the printer.

Further, in the back-shooter type ink-jet printhead, since the nozzle plate 3 is formed on the substrate 1 by using the CVD method, the thickness of the nozzle plate 3 is less than that (above about 10 μm) in the edge-shooter type or roof-shooter type ink-jet printhead. The strength of the nozzle plate 3 decreases. Further, in the back-shooter type ink-jet printhead, since the heater 2 is formed in the lower portion of the nozzle plate 3, the nozzle plate 3 is prone to be contaminated by the ink sludge.

Accordingly, the nozzle is required to be wiped and cleaned more frequently than that of the edge-shooter type or roof-shooter type ink-jet printhead. In addition, in the back-shooter type ink-jet printhead, nevertheless the ink introducing and ejecting directions coincide with each other, it is observed that the ejection of the ink is less stable than in the edge-shooter type or the roof-shooter type ink-jet printhead. This is because the thickness of the nozzle plate 3 is too small to become uniform or the shape of the nozzle 3*a* cannot be ideally formed.

SUMMARY OF THE INVENTION

It is, therefore, an object of the present invention to provide an ink-jet printhead and a method of manufacturing the same, which has good ejection performance as well as high productivity due to the easy production thereof.

Additional objects and advantageous of the invention will be set forth in part in the description which follows and, in part, will be obvious from the description, or may be learned by practice of the invention.

In accordance with the above and other objects of the present invention, there is provided an ink-jet printhead comprising a substrate, a heater formed on a top surface of the substrate; an ink chamber barrier formed on the substrate to enclose the heater, an ink chamber defined by the substrate and the ink chamber barrier, the substrate forming a bottom surface of the ink chamber while the ink chamber barrier defines a sidewall of the ink chamber, an ink passage extending through the substrate in a direction perpendicular to a major surface of the heater, the ink passage communicating with the ink chamber, and a nozzle plate stacked on an upper portion of the ink chamber and having a nozzle for ejecting ink.

The heater has an opening at a center portion thereof, and the opening concentrically communicates with the nozzle and the ink passage. The ink chamber barrier is preferably made of a dry film or a thermal fusion film.

Meanwhile, the ink passage includes a narrow passage formed in an upper portion of the substrate, the narrow passage communicating with the ink chamber; and a wide passage having a greater cross-sectional area than that of the narrow passage, the wide passage formed in a lower portion of the substrate and communicating with the narrow passage.

In accordance with the above and other objects of the present invention, there is provided a method of manufacturing an ink-jet printhead, comprising forming an insulation film on a substrate, depositing a metal layer onto the insulation film and patterning it to form a heater, forming an electrical wire on the substrate, etching the substrate at a desired depth from a top surface of the substrate in a direction perpendicular to the major surface of the heater to form a narrow passage, depositing an ink chamber barrier layer and patterning it to form an ink chamber enclosing the heater, stacking a nozzle plate having a nozzle on an upper portion of the ink chamber barrier layer, and applying desired pressure and temperature onto the nozzle plate to bond the nozzle plate and the substrate, and etching the substrate from a bottom surface thereof to form a wide passage communicating with the narrow passage.

In addition, the method further comprises stacking a protective layer on the heater after the formation of the electrical wire, depositing a material having a different composition from the substrate onto a bottom surface of the narrow passage, after the formation of the narrow passage, in order to determine an ending point of etching of the wide passage, and depositing a hydrophobic thin film on a surface of the nozzle plate after the formation of the wide passage.

BRIEF DESCRIPTION OF THE DRAWINGS

The above and other objects and features of the present invention will become apparent and more readily appreciated from the following description of the preferred embodiments, given in conjunction with the accompanying drawings of which:

FIG. 8 is a plan view showing an ink-jet printhead before the nozzle plate is attached in accordance with yet another embodiment of the present invention.

DETAILED DESCRIPTION OF THE PREFERRED EMBODIMENTS

Figure 1:
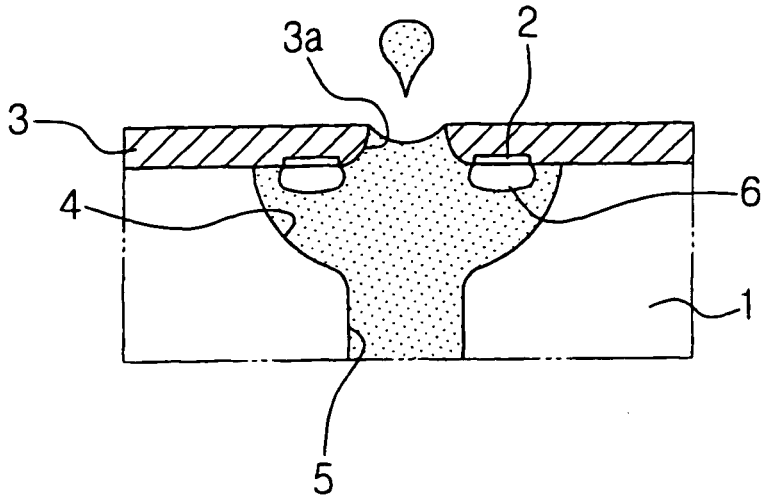
FIG. 1 (PRIOR ART)
FIG. 1 shows a schematic side cross-sectional view of a conventional ink-jet printhead.

Reference will now be made in detail to the present embodiment of the present invention, examples of which are illustrated in the accompanying drawings, wherein like reference numerals refer to like elements throughout.

Figure 2:
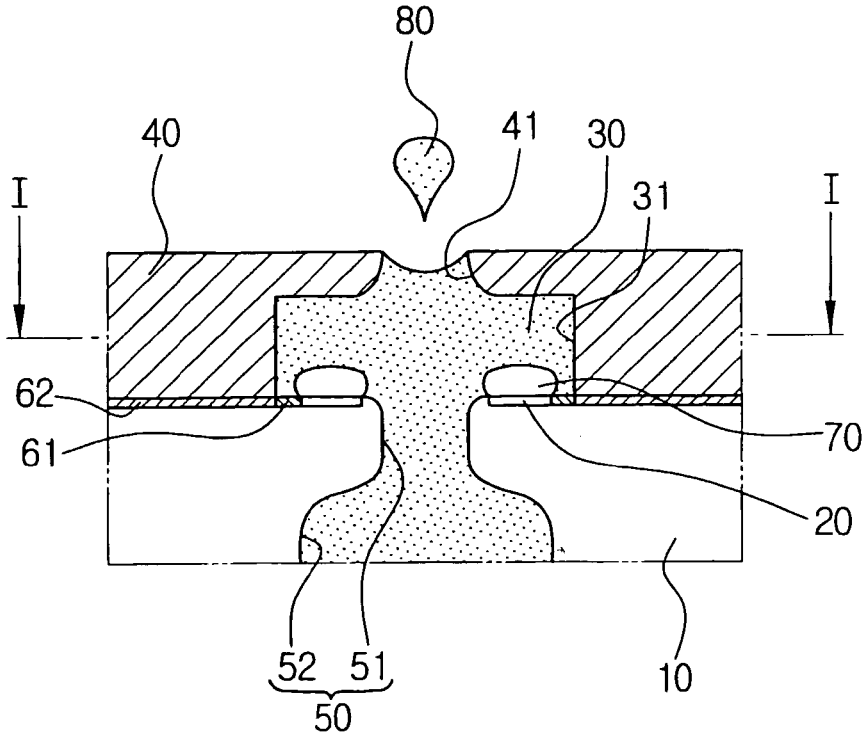
FIG. 2 illustrates a schematic side cross-sectional view of an ink-jet printhead in accordance with an embodiment of the present invention.

As shown in FIG. 2, an ink-jet printhead in accordance with an embodiment of the present invention comprises a substrate 10 made of silicone or glass, a heater 20 formed on an upper portion of the substrate 10, an ink chamber 30 disposed above the heater 20, an ink chamber barrier 31 stacked on the substrate 10 to enclose the heater 20 and to form a sidewall of the ink chamber 30, a nozzle plate 40 stacked on the ink chamber barrier 31 and having a nozzle 41, and an ink passage 50 extending through the substrate 10 in a perpendicular direction to a major surface of the heater 20 on which heat is transferred to the ink.

Although not shown, a driving circuit for actuating the heater 20 is formed on the substrate 10. In order to electrically connect the driving circuit to the heater 20, electrodes 61 and electrical metal wires 62 are formed on the upper surface of the substrate 10. The electrodes 61 contact the heater 20. The electrical metal wires 62 electrically connect the driving circuit to the electrodes 61, respectively.

The ink passage 50 includes a narrow passage 51 formed in the upper portion of the substrate 10 to communicate with the ink chamber 30, and a wide passage 52 formed in a lower portion of the substrate 10 to communicate with the narrow passage 51. The wide passage 52 has a cross-sectional area greater than that of the narrow passage 51. By making the cross-sectional area of the narrow passage 51 less than that of the wide passage 52 as described above, the ink filled in the ink chamber 30 is prevented from flowing back toward the wide passage 52.

Figure 3:
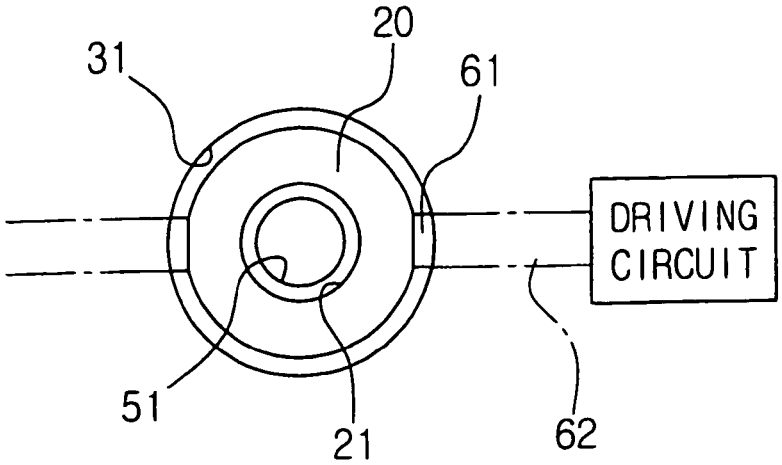
FIG. 3 is a cross-sectional view taken along line 1—1 in FIG. 2.

As shown in FIG. 3, the heater 20 has a doughnut shape with an opening 21 formed at a center portion thereof. The opening 21 is arranged to concentrically communicate with the nozzle 41, the narrow passage 51 and the wide passage 52. The heater 20 is made of Ta—Al. Alternatively, the heater 20 may be made of TiN and TiW which are proven as being stable in the semiconductor field, and may be made of Si-metal alloy capable of forming a stable oxide film.

Figure 4:
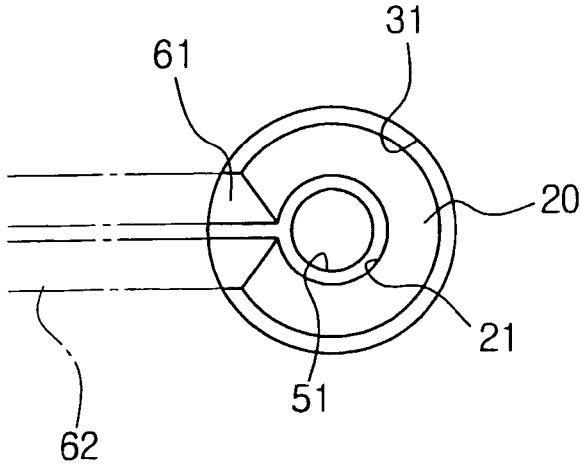
FIG. 4 is a view showing an alternative embodiment of an electrode and an electrical wire in the ink-jet printhead shown in FIG. 3.

The electrodes 61 are provided in a pair and the pair of electrodes 61 are opposed to each other about the heater 20. That is, the pair of electrodes 61 are spaced at an angle of 180° around the heater 20 to contact the opposite sides of the latter, respectively. On the other hand, as shown in FIG. 4, the pair of electrodes 61 may be disposed side-by-side to contact one side of the heater 20.

In the ink-jet printhead shown in FIG. 2, when electric current is applied from the driving circuit through in turn the electrical wire 62 and the electrode 61 to the heater 20, temperature of the heater 20 increases. As the temperature of the heater 20 increases, a bubble 70 is formed on the major surface of the heater 20 and grows. The internal pressure of the ink chamber 30 increases as the bubble 70 grows so big that the ink filled in the ink chamber 30 is forced outwardly of the nozzle plate 40 through the nozzle 41. The ink protruding from the nozzle 41 creats an ink column having a column shape.

At that time, when the amount of the current applied to the heater 20 is decreased or the current is cut off, the heater 20 is cooled and the bubble 70 is shrunk. Due to the shrinkage of the bubble 70, a negative pressure is generated in the ink chamber 30 so that the ink column is cut off into two pieces. While a leading portion of the ink column becomes an ink droplet 80 which is then ejected onto the print medium, a trailing portion of the ink column is drawn back into the ink chamber 30. After the ink droplet 80 is ejected, the ink chamber 30 is replenished with fresh ink supplied through the ink passage 50 by the capillary phenomenon.

The process of manufacturing the ink-jet printhead shown in FIG. 2 will now be described with reference to FIGS. 5A–5J.

Driving Circuit Forming Process

Figure 5A:
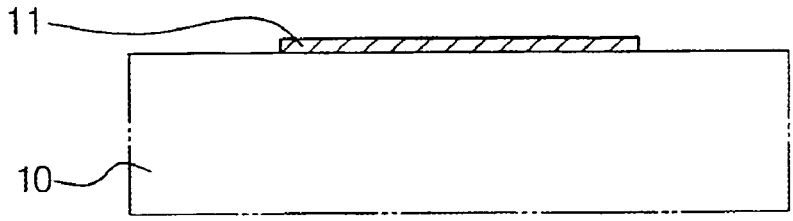
FIGS. 5A to 5J are side cross-sectional views sequentially showing the manufacturing process of the ink-jet printhead in FIG. 2.

First, the driving circuit for actuating the heater 20 is formed on a top surface of the substrate 10. The driving circuit is formed in a thin film transistor ("TFT") fashion by using a standard negative metal oxide semiconductor ("NMOS") process which is commonly used in a semiconductor manufacturing process. At that time, as shown in FIG. 5A, in order to insulate the heater 20 from the substrate 10, an insulation film 11 comprised of $SiO_2$ remains on the top surface of the substrate 10 in a region where the heater 20 is formed by a process different from the standard NMOS process.

Heater Forming Process

Figure 5B:
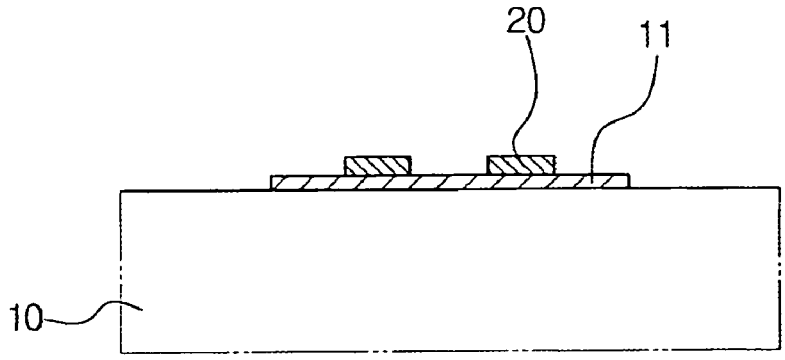

As shown in FIG. 5B, the metal layer of Ta—Al is deposited onto the insulation film 11, the Ta—Al layer is etched in a doughnut-shape to form the heater 20.

Electrical Wire Forming Process

Figure 5C:
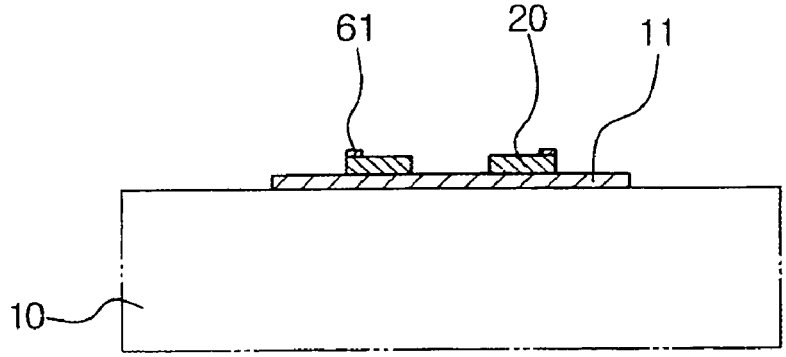

As shown in FIG. 5C, an Al layer is deposited onto the top surface of the heater 20 and the driving circuit, the Al layer is patterned to form the electrodes 61 and electrical wires 62. The electrical wires 62 may be formed in a single layer, but when a plurality of nozzles 41 are formed in a unit chip, they are preferably formed in two or more layers.

Figure 5D:
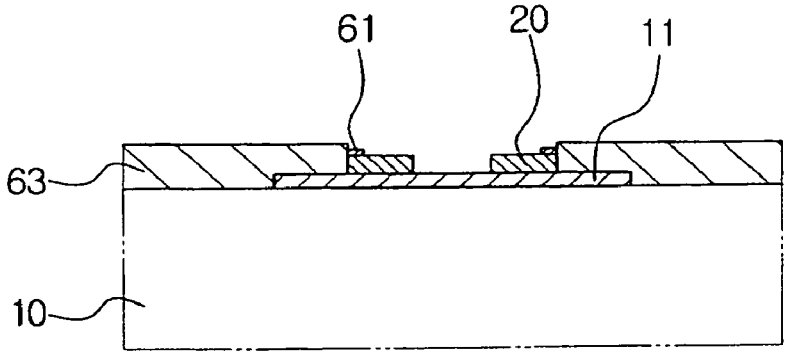
Figure 5E:
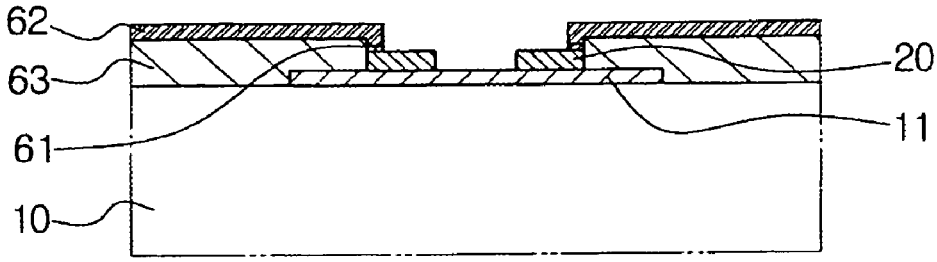

In order to form the electrical wire 62 of two layers, as shown in FIG. 5D, boron phosphorus silicate glass ("BPSG") is deposited onto the Al layer, and the BSPG is then etched to form an intermediate insulation film 63.

Next, as shown in FIG. 5E, the Al layer is again deposited onto the intermediate layer 63 and etched to form the electrical wires 62.

Protective Layer Forming Process

Figure 5F:
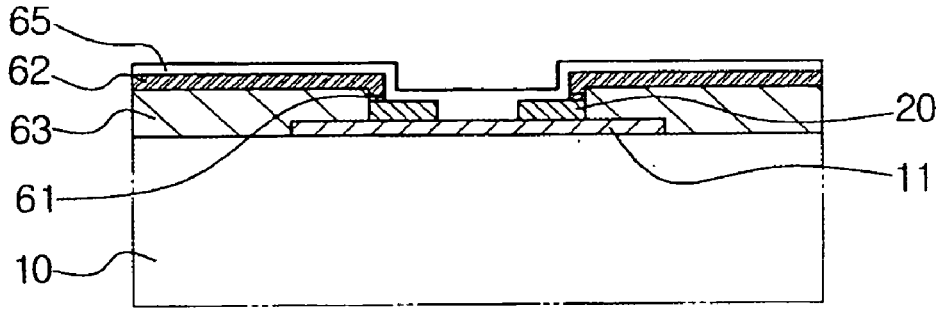

As shown in FIG. 5F, a protective layer 65 made of $Si_3N_4$/SiC is deposited onto both the heater 20 and the electrical wires 62. The protective layer prevents the heater 20 and the electrical wires 62 from reacting with the ink and insulates the heater 20. Further, the protective layer 65 protects the heater 20 from shock generated when the bubble 70 disappears.

Narrow Passage Forming Process

Figure 5G:
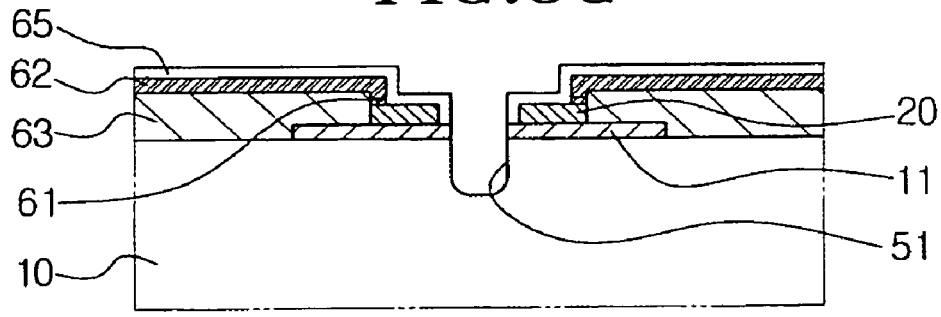

As shown in FIG. 5G, the narrow passage 51 is formed by a dry etching method of etching the upper portion of the substrate 10. At that time, a depth of the narrow passage 51 is preferably about 20 μm from the top surface of the substrate 10. A pattern of the narrow passage 51 as viewed from the top can be formed in various fashions by using a mask. As the mask, a general photo-resistor or the protective layer 65 which is patterned may be used.

Figure 6A:
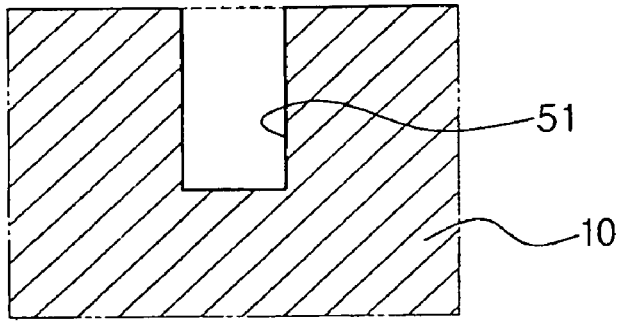
FIGS. 6A to 6D are partial cross-sectional views showing various alternatives of a narrow passage in the ink-jet head shown in FIG. 2.
Figure 6B:
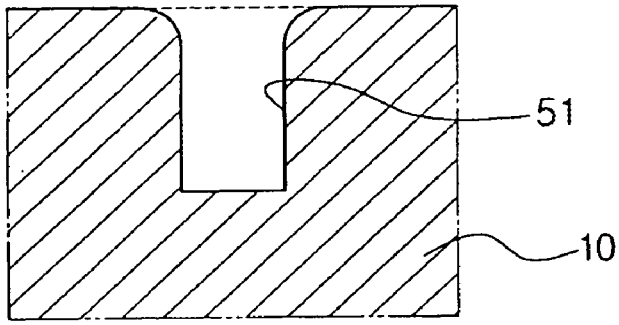
Figure 6C:
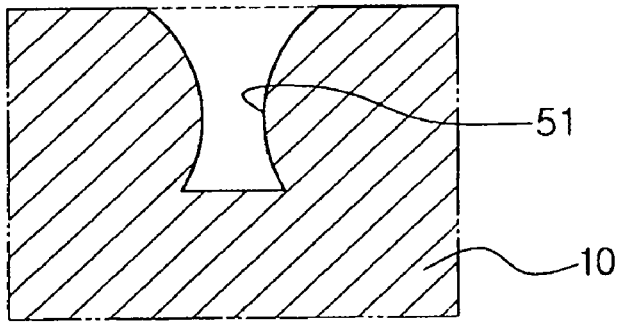
Figure 6D:
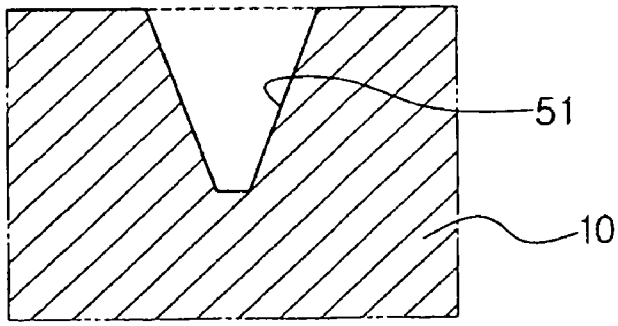

On the other hand, a shape of the narrow passage 51 in a cross-sectional view, is substantially rectangular as shown in FIG. 6A, and may vary by etching the substrate 10 using plasma. That is, the shape in the cross-section of the narrow passage 51 may be formed in various fashions. A top end of the substrate 10 contacting the ink chamber 30 may be rounded as shown in FIG. 6B. The narrow passage 51 may have a shape with a central portion being less than those in upper and lower portions of the narrow passage as shown in FIG. 6C, and may have a trapezoidal shape as shown in FIG. 6D.

Ink Chamber Barrier Forming Process

Figure 5H:
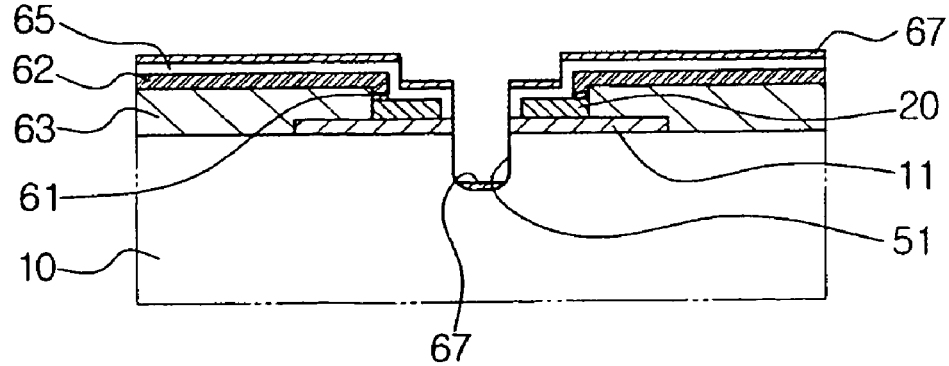
Figure 5I:
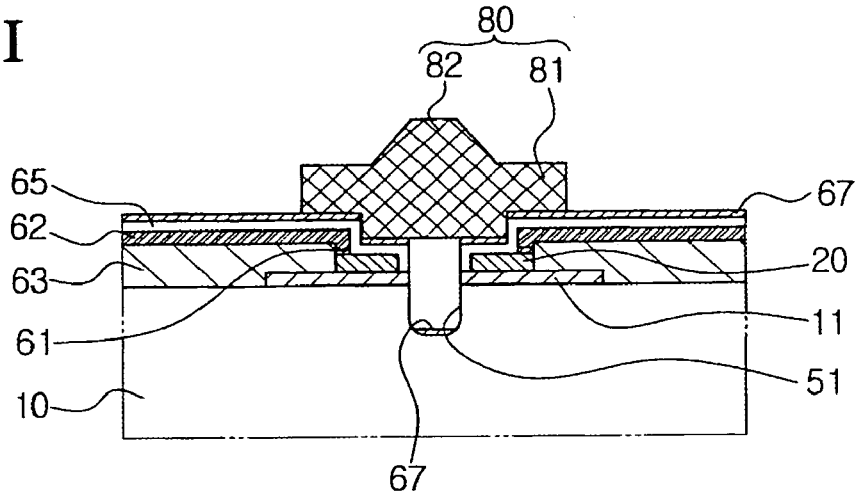

As shown in FIG. 5H, after a dry film is deposited onto the top surface of the substrate 10 and the heater 20, the dry film is etched to expose the heater 20 and thus forms the ink chamber barrier 31. Meanwhile, the ink chamber barrier 31 may be formed by depositing the dry film onto the lower surface of the nozzle plate 40 and then patterning the dry film.

It is preferable that the dry film is not reacted with the ink and has heat resistance. Meanwhile, the ink chamber barrier 31 may be formed using a thermal fusion film, which has excellent characteristics in aspects of the reactivity with the ink and the heat resistance. In this case, the thermal fusion film is patterned by a mechanical method to form the ink chamber barrier 31.

Substrate and Nozzle Plate Bonding Process

As shown in FIG. 51, the nozzle plate 40 in which the nozzle 41 is formed is put on the ink chamber barrier 31, and desired pressure and temperature are applied thereon. Then, the dry film forming the ink chamber barrier 31 is fused and thus the substrate 10 and the nozzle plate 40 are bonded. That is, the dry film functions as an adhesive layer for bonding the substrate 10 and the nozzle plate 40 as well as for forming the ink chamber barrier 31. In case the ink chamber barrier 31 is formed using the thermal fusion film instead of the dry film, the patterned thermal fusion film is arranged between the substrate 10 and the nozzle plate 40 and then the desired pressure and temperature are applied thereon to bond the substrate 10 and the nozzle plate 40.

Meanwhile, the nozzle plate 40 may be formed by electroforming a metallic material, such as Ni, or by punching of a stainless sheet. The nozzle 41 is formed by laser-processing of the nozzle plate 40 made of polymer.

Wide Passage Forming Process

Figure 5J:
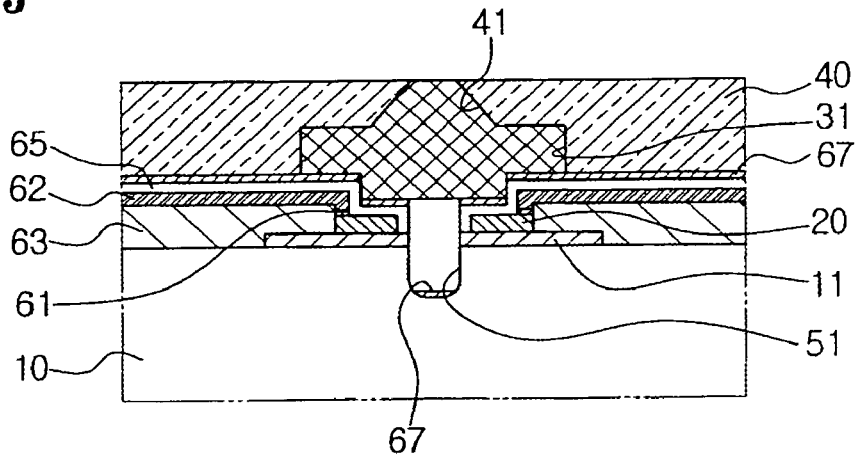
Figure 5K:
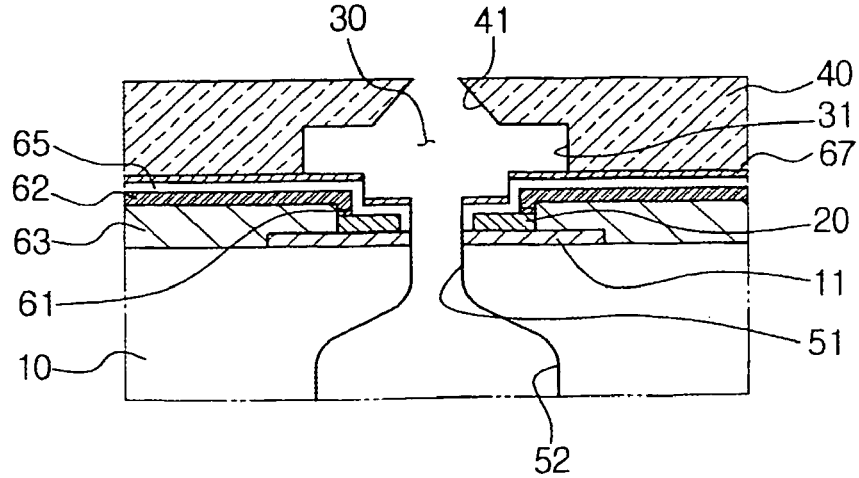

As shown in FIG. 5J, when the substrate 10 and the nozzle plate 40 are completely bonded, the wide passage 52 is formed by etching the lower portion of the substrate 10 using a dry etching method. In order to form the wide passage 52, the silicon oxide film (not shown) deposited on the bottom surface of the substrate 10 is patterned and used as a mask. The silicon oxide film is preferably formed in an initial process of manufacturing the substrate 10.

When the wide passage 52 is formed, the depth of etching is critical. If the depth of etching is too great, there is a risk that the narrow passage 51 becomes too short or does not exist. If the depth of etching is too small, the wide passage 52 does not communicate with the narrow passage 51. Therefore, it is preferable to determine an ending point of the etching that the wide passage 52 and the narrow passage 51 come to meet each other while observing an etching processing state of the substrate 10 rather than by the etching time.

The ending point of etching may be determined by using an optical sensor, a method of analyzing the plasma composition, and a method of measuring a variance in a bias voltage applied to the electrode generating plasma.

The optical sensor is used to determine the ending point of etching by measuring an internal luminous intensity of the wide passage 52 during etching the substrate 10. That is, if the wide passage 52 communicates with the narrow passage 51, the internal luminous intensity detected by the optical sensor increases. At that time, the etching is finished.

In the present embodiment, the plasma composition analyzing method is used to determine the ending point of etching. The plasma composition analyzing method is to determine the ending point of etching by analyzing the composition of plasma while etching the substrate 10. As described above, the seed layer 67, which is of a different composition from the substrate 10, is stacked on the bottom surface of the narrow passage 51. Therefore, when the etching of the substrate 10 progresses and the wide passage 52 comes to communicate with the narrow passage 51, the seed layer 67 is etched, thereby varying the composition of the plasma. At that time, the etching is finished. Furthermore, the protective layer 65, the intermediate insulation film 63, the insulation film 11 and the nozzle 40 are processed, as would be understood by one of ordinary skill in the art, to achieve the structure of FIG. 2.

The method of measuring the variance in a bias voltage determines the ending point of etching by measuring the variance in the bias voltage applied to the electrode to generate the plasma. That is, when the wide passage 52 becomes communicating with the narrow passage 51, the status of plasma varies. Thus, the bias voltage applied to the electrode to generate the plasma is also varied. At that time, the etching is finished. In case the material having the different composition from the substrate 10 is etched, the status variation of plasma also increases. Therefore, in the same way as the plasma composition analyzing method, it is preferable that the material having the different composition from the substrate 10 is deposited on the bottom surface of the narrow passage 51 after the narrow passage 51 is formed.

Hydrophobic Thin Film Coating Process

After the process of fabricating the printhead is completed, as described above, a hydrophobic thin film is coated on an outer surface of the nozzle plate 40 by a directional deposition method using plasma. When coated on the surface of the nozzle plate 40, the hydrophobic thin film is not coated on the entire surface of the heater 20 because the opening 21 of the heater 20 is located below the nozzle 41.

Ink Wettability Enhanced Process

On the other hand, in the substrate 10 made of silicon and the ink chamber barrier 31 made of the dry film, ink wettability is poor. In order to improve the ink wettability in the narrow and wide passages 51, 52 and the ink chamber 30, it is preferable to flow liquid or gas, which is good for the ink wettability and contains the similar composition to ink, into the narrow and the wide passages 51, 52 and the ink chamber 30.

Figure 7:
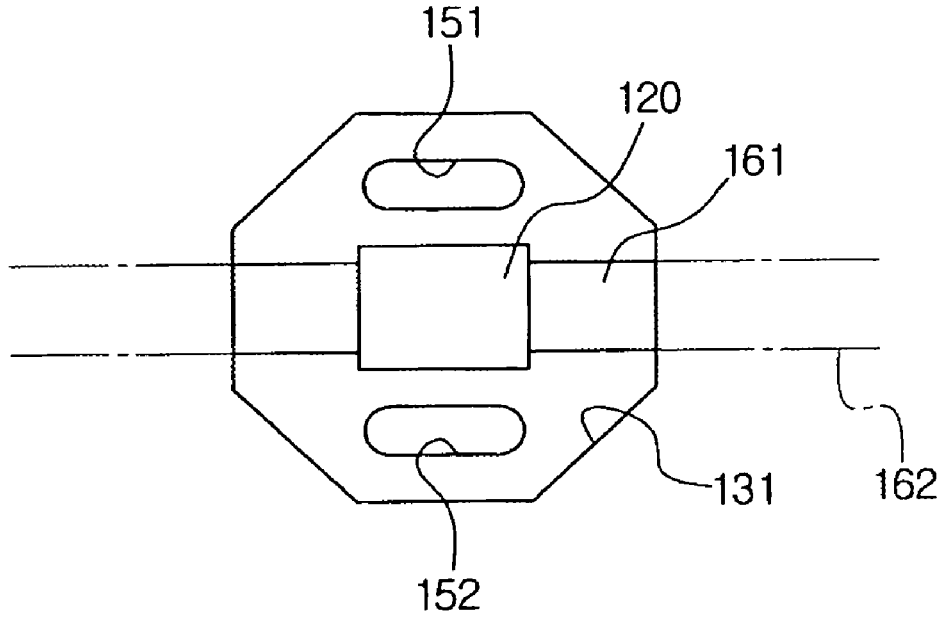
FIG. 7 is a plan view showing an ink-jet printhead before the nozzle plate is attached in accordance with another embodiment of the present invention.

FIGS. 7 and 8 show other embodiments of the present invention with respect to the configuration of the heater and the orientation of the ink passage.

An ink-jet printhead shown in FIG. 7 comprises a rectangular heater 120, an ink chamber barrier 131 enclosing the heater 120, a pair of ink passages 151, 152 disposed on right and the left sides of the heater 120. The heater 120 is electrically connected to a driving circuit through electrodes 161 and electrical wires 162. Each of the ink passages 151, 152, similar to that of the ink passage 151, 152 of the ink-jet printhead in FIG. 2, is formed perpendicular to the surface of the heater 120 and may include the narrow passage 51 and the wide passage 52 communicating with each other. On the other hand, the ink-jet printhead in FIG. 7 has the same constitution as the ink-jet printhead in FIG. 2 except for the configuration of the heater 120 and the number of the ink passages 151, 152.

An ink-jet printhead shown in FIG. 8 comprises one ink passage 250, a pair of rectangular heaters 221 and 222 respectively disposed on right and left sides of an ink passage 250, and a pair of ink chamber barriers 231 and 232 enclosing each of the heaters 221 and 222. The heaters 221 and 222 are electrically connected to the driving circuit through electrodes 261 and electrical wires 262. According to the ink-jet printhead, since one ink passage is formed for two heaters 221, 222, thereby preventing the substrate 10 from being weak.

As described above, according to the ink-jet printhead of the present invention, since the ink introducing direction for supplying the ink into the ink chamber 30 via the ink passage 50 is coincident with the ink ejecting direction for ejecting the ink from the ink chamber 30 through the nozzle 41, the ejection of the ink is stable and the cross-talk between the adjacent nozzles is reduced in comparison with the roof-shooter type or edge-shooter type ink-jet printhead.

Further, according to the ink-jet printhead of the present invention, since it is manufactured by forming the ink chamber barrier 31 made of the dry film or the thermal fusion film on the substrate 10 and then bonding the substrate 10 on the ink chamber barrier 31, the bonding process is performed only once to complete the ink-jet printhead, thereby resulting in easy production and hence high productivity compared with the roof-shooter type or edge-shooter type ink-jet printhead.

Further, in the ink-jet printhead, the ink chamber barrier 31 of the ink chamber 30, which forms the sidewall of the ink chamber 30, is provided between the substrate 10 and the nozzle plate 40. Therefore, in comparison with the back-shooter type of ink-jet printhead shown in FIG. 2, the ink ejection frequency of the ink-jet printhead increases due to the high cooling rate of the heater 20, and the strength of the nozzle plate 40 increases because the thickness of the nozzle plate 40 can be maintained properly or uniformly.

In conclusion, with the ink-jet printhead of the present invention, the problems of the cooling rate of the heater and the strength of the nozzle plate occurring in the back-shooter type ink-jet printhead are solved.

While the invention has been shown and described with reference to the preferred embodiments thereof, it will be understood by those skilled in the art that various changes in form and details may be made therein without departing from the principles and sprit of the invention, the scope of which is defined by the claims and their equivalents.

What is claimed is:

1. An ink-jet printhead, comprising:

a substrate;

a heater formed on a top surface of the substrate and having a top surface flush with the top surface of the substrate;

a nozzle plate stacked directly on the substrate, the nozzle plate having a nozzle through which ink is ejected;

an ink chamber having a cavity enclosing the heater, the ink chamber communicating with the nozzle; and an ink passage extending through the substrate in a direction perpendicular to the top surface of the heater, the ink passage communicating with the ink chamber, wherein the heater comprises an opening at a center portion thereof, and the opening concentrically communicates with the nozzle and the ink passage.

2. The ink-jet printhead of claim 1, wherein the nozzle plate is formed by an Ni electroforming.

3. The ink-jet printhead of claim 1, further comprising a pair of the ink passages, wherein the heater is disposed between the pair of the ink passages.

4. The ink-jet printhead of claim 3, wherein each of the pair of the ink passages comprises:

a narrow passage formed in an upper portion of the substrate, the narrow passage communicating with the ink chamber; and a wide passage having a greater cross-sectional area than a cross sectional area of the narrow passage, the wide passage formed in a lower portion of the substrate and communicating with the narrow passage.

5. The ink-jet printhead of claim 1, further comprising:

a metal wiring;

a driving circuit to actuate the heater, the driving circuit formed on the substrate; and an electrode comprising:

a first end electrically connected to the heater, and a second end connected through the metal-wiring to the driving circuit.

6. The ink-jet printhead of claim 5, further comprising a pair of the electrodes opposed to each other about the heater.

7. The ink-jet printhead of claim 1, wherein the substrate comprises silicon or glass.

8. The ink-jet printhead of claim 1, wherein a width of the heater is less than a width of the nozzle plate and the substrate.

9. An ink-jet printhead, comprising:

a substrate;

a heater formed on a top surface of the substrate;

a nozzle plate stacked directly on the substrate, the nozzle plate having a nozzle through which ink is ejected;

an ink chamber having a cavity enclosing the heater, the ink chamber communicating with the nozzle; and an ink passage extending through the substrate in a direction perpendicular to a surface of the heater, the ink passage communicating with the ink chamber, wherein the heater comprises an opening at a center portion thereof, and the opening concentrically communicates with the nozzle and the ink passage, wherein the ink passage comprises:

a narrow passage formed in an upper portion of the substrate, the narrow passage communicating with the ink chamber; and a wide passage having a greater cross-sectional area than a cross sectional area of the narrow passage, the wide passage formed in a lower portion of the substrate and communicating with the narrow passage.

10. An ink-jet printhead, comprising:

a substrate;

a heater in contact with a top surface and a side surface of the substrate, wherein the heater comprises an opening at a center portion thereof;

a nozzle plate stacked on the substrate, the nozzle plate having a nozzle through which ink is ejected;

an ink chamber having a cavity enclosing the heater, the ink chamber communicating with the nozzle;

an ink passage extending through the substrate in a direction perpendicular to a surface of the heater, the ink passage communicating with the ink chamber, and the opening of the heater concentrically communicating with the nozzle and the ink passage;

a metal wiring;

a driving circuit to actuate the heater, the driving circuit formed on the substrate; and a pair of electrodes each comprising:

a first end electrically connected to the heater, and a second end connected through the metal-wiring to the driving circuit, the electrodes being disposed side by side and contacting a side of the heater.

11. An ink-jet printhead, comprising:

a substrate;

a heater having a top surface which is flush with a top surface of the substrate, wherein the heater comprises an opening at a center portion thereof;

a nozzle plate stacked on the substrate, the nozzle plate having a nozzle through which ink is ejected;

an ink chamber having a cavity enclosing the heater, the ink chamber communicating with the nozzle;

an ink passage extending through the substrate in a direction perpendicular to a surface of the heater, the ink passage communicating with the ink chamber, and the opening of the heater concentrically communicating with the nozzle and the ink passage; a metal wiring;

a driving circuit to actuate the heater, the driving circuit formed on the substrate; and an electrode comprising:

a first end electrically connected to the heater, and a second end connected through the metal-wiring to the driving circuit, wherein the driving circuit is a TFT.

12. An ink-jet printhead, comprising:

a substrate comprising a top surface;

a nozzle plate stacked directly on the substrate, the nozzle plate having a nozzle through which ink is ejected;

an ink chamber formed by the nozzle plate, the ink chamber communicating with the nozzle;

an ink passage extending through the substrate and communicating with the ink chamber; and a heater comprising an opening and having a top surface flush with the top surface of the substrate, the nozzle, the ink passage and the opening being arranged in a line.

13. The ink-jet printhead of claim 12, wherein the ink passage extends in a direction perpendicular to the top surface of the heater.

14. The ink-jet printhead of claim 12, wherein the ink-jet printhead is monolithic.

15. The ink-jet printhead of claim 12, further comprising:

a rectangular heater between the substrate and the nozzle plate;

a first electrode electrically connected to the heater;

a second electrode electrically connected to the heater and on an opposite side of the heater from the first electrode.

16. The ink-jet printhead of claim 15, wherein the ink passage comprises first and second ink passages on opposite sides of the heater from each other.

17. An ink-jet printhead, comprising:

a substrate;

a nozzle plate stacked directly on the substrate, the nozzle plate having a nozzle through which ink is ejected;

an ink chamber formed by the nozzle plate, the ink chamber communicating with the nozzle;

an ink passage extending through the substrate and communicating with the ink chamber; and a heater comprising an opening, the nozzle, the ink passage and the opening being arranged in a line, wherein the ink passage comprises:

a first passage formed in the substrate, the first passage communicating with the ink chamber and having a first cross sectional area; and a second passage having a second cross sectional area greater than the first cross sectional area, the second passage communicating with the first passage.

18. The ink-jet printhead of claim 17, wherein the heater is a doughnut shaped heater, the printhead further comprising:

a first electrode electrically connected to the heater; and a second electrode electrically connected to the heater and on an opposite side of the heater from the first electrode.

19. An ink-jet printhead, comprising:

a substrate;

a nozzle plate on the substrate, the nozzle plate having a nozzle through which ink is ejected;

an ink chamber formed by the nozzle plate, the ink chamber communicating with the nozzle;

an ink passage extending through the substrate and communicating with the ink chamber, comprising:

a first passage formed in the substrate, the first passage communicating with the ink chamber and having a first cross sectional area, and a second passage having a second cross sectional area greater than the first cross sectional area, the second passage communicating with the first passage;

a doughnut shaped heater having a top surface flush with a top surface of the substrate;

a first electrode electrically connected to the heater; and a second electrode electrically connected to the heater and on a same side of the heater as the first electrode.

20. An ink-jet printhead, comprising:

a substrate comprising a top surface;

a nozzle plate stacked on the substrate, the nozzle plate having a nozzle through which ink is ejected;

an ink chamber, defined by an ink chamber barrier, the nozzle plate and the ink chamber barrier being monolithic, the ink chamber communicating with the nozzle;

an ink passage extending through the substrate and communicating with the ink chamber; and a heater comprising an opening and a top surface flush with the top surface of the substrate, the nozzle, the ink passage and the opening being arranged in a line.

21. The ink-jet printhead of claim 20, wherein the substrate comprises a single layer.

* * * * *